US010844661B1

(12) United States Patent
Halloran et al.

(10) Patent No.: US 10,844,661 B1
(45) Date of Patent: Nov. 24, 2020

(54) STEP ATTACHMENT FOR LADDERS

(71) Applicant: Alex Lan, Dublin, CA (US)

(72) Inventors: Kevin John Halloran, Castro Valley, CA (US); Michael Halloran, Walnut Creek, CA (US)

(73) Assignee: Alex Lan, Dublin, CA (US)

( * ) Notice: Subject to any disclaimer, the term of this patent is extended or adjusted under 35 U.S.C. 154(b) by 0 days.

(21) Appl. No.: 15/890,160

(22) Filed: Feb. 6, 2018

Related U.S. Application Data

(60) Provisional application No. 62/603,499, filed on Jun. 1, 2017.

(51) Int. Cl.
*E06C 7/16* (2006.01)

(52) U.S. Cl.
CPC ..... *E06C 7/165* (2013.01)

(58) Field of Classification Search
CPC ..... E06C 7/00; E06C 7/10; E06C 7/08; E06C 7/087; E06C 7/165; E06C 7/16
See application file for complete search history.

(56) References Cited

U.S. PATENT DOCUMENTS 313,465 A * 3/1885 Worsley ..... E06C 7/165 182/120
1,042,192 A * 10/1912 Boilot ..... E06C 7/16 182/121
2,486,783 A * 11/1949 Hartman ..... E06C 7/165 182/120
2,522,821 A * 9/1950 Hansen ..... E06C 7/16 248/238
2,606,079 A * 8/1952 White ..... E06C 7/16 182/121
2,759,620 A * 8/1956 Pharris ..... B44D 3/126 15/257.06
2,827,336 A * 3/1958 Johnson ..... E06C 7/165 182/120
2,888,225 A * 5/1959 McQuin ..... E04G 3/26 248/237
3,067,836 A * 12/1962 Carnicelli ..... E06C 7/16 182/121
3,081,839 A * 3/1963 O'Brien ..... E06C 7/16 182/103
3,164,353 A * 1/1965 Rene ..... E04G 3/26 248/237
3,318,416 A * 5/1967 Robinson ..... E06C 1/345 182/111
3,422,923 A * 1/1969 Lund ..... E06C 7/14 182/120
4,342,374 A * 8/1982 Montana ..... E04D 13/12 182/121
4,424,949 A * 1/1984 Kimmett ..... B05C 21/00 15/257.06

(Continued)

*Primary Examiner* — Katherine W Mitchell
*Assistant Examiner* — Shiref M Mekhaeil
(74) *Attorney, Agent, or Firm* — Thomas M. Freiburger

(57) ABSTRACT

A portable step platform fits onto the hollow rungs of an extension or step ladder, providing support, security and comfort for the user performing work related tasks on the ladder. A user can easily move the device up or down on the ladder, or swing the platform out of the way when ascending or descending. Tilt adjustment is facilitated for the foot platform, to accommodate different ladder inclinations. In addition, the portable step platform is configured to allow support of a scaffold plank on the top surface.

2 Claims, 9 Drawing Sheets

(56) References Cited

U.S. PATENT DOCUMENTS 4,450,935 A * 5/1984 Gustavus ..... E04G 3/26 182/45
4,542,874 A * 9/1985 Ronning ..... E06C 7/16 182/121
4,546,853 A * 10/1985 Hanson ..... E06C 7/16 182/103
4,618,030 A * 10/1986 Campbell ..... E06C 7/16 182/121
4,941,547 A * 7/1990 Livick ..... E06C 7/16 182/107
4,953,661 A * 9/1990 Hilton ..... E06C 7/14 182/120
5,020,757 A * 6/1991 Sulecki ..... E04G 1/30 248/238
5,052,581 A * 10/1991 Christ ..... E06C 7/14 15/257.06
5,079,795 A * 1/1992 Schmid ..... B44D 3/126 15/257.06
5,388,665 A * 2/1995 Newman ..... E06C 7/16 182/118
5,446,969 A * 9/1995 Terenzoni ..... B25H 7/00 33/419
5,601,154 A * 2/1997 Eisenmenger ..... E04D 15/00 182/45
6,045,102 A * 4/2000 Terenzoni ..... E04D 15/00 248/238
7,509,702 B2 * 3/2009 Cantis ..... E04G 3/26 14/78
8,047,330 B1 * 11/2011 English ..... E06C 7/48 182/117
8,047,331 B2 * 11/2011 Spicer ..... E06C 5/02 182/127
8,776,947 B1 * 7/2014 Wurth ..... E06C 1/12 14/69.5
8,979,053 B2 * 3/2015 Deal ..... E06C 7/48 182/116
9,016,433 B1 * 4/2015 Duffy ..... E04G 3/26 182/45
9,567,804 B2 * 2/2017 Youlyahshiev ..... E06C 1/36
9,951,557 B2 * 4/2018 Roseveare, Jr. ..... E06C 7/488
10,119,332 B1 * 11/2018 Schellens ..... E06C 7/165
2004/0163890 A1 * 8/2004 Nash, Jr. ..... E06C 7/16 182/122
2006/0124390 A1 * 6/2006 Rivers ..... E06C 7/003 182/18
2010/0288583 A1 * 11/2010 Becker ..... E04G 3/24 182/128
2011/0203873 A1 * 8/2011 Perry ..... E06C 7/14 182/129
2013/0068560 A1 * 3/2013 Estep ..... E06C 7/10 182/107
2014/0209411 A1 * 7/2014 McCarthy ..... E06C 1/345 182/129
2014/0326538 A1 * 11/2014 Najey ..... E06C 7/08 182/129
2016/0186494 A1 * 6/2016 Matthew ..... E06C 1/18 182/107
2016/0376844 A1 * 12/2016 Najey ..... E06C 7/165 182/120

* cited by examiner

FIG. 7A
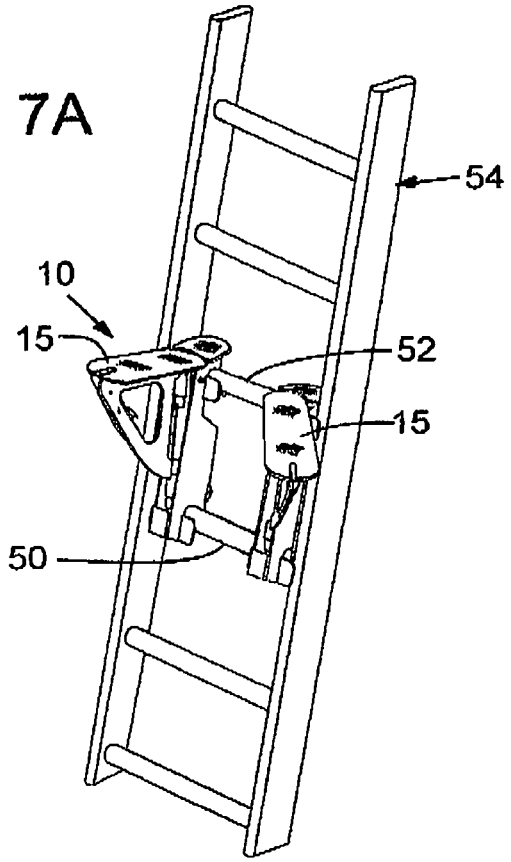
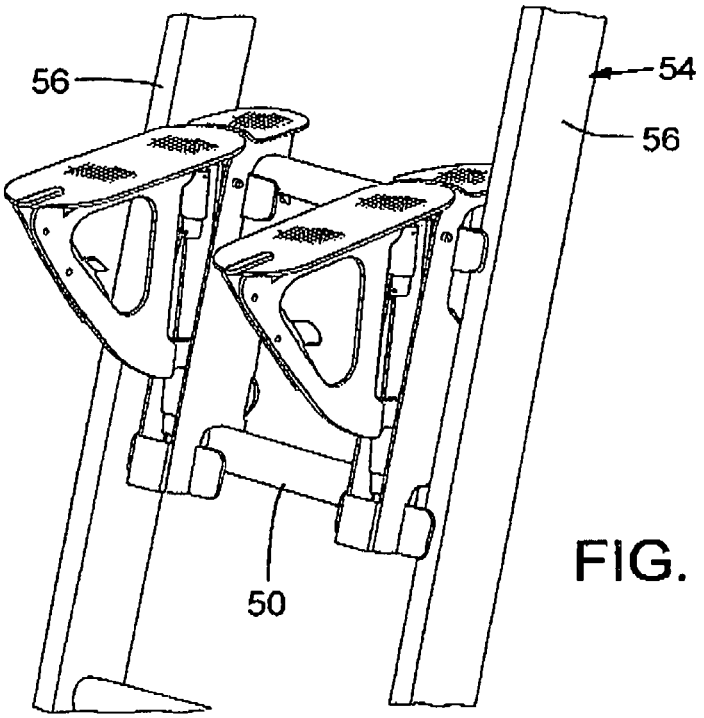
FIG. 7B

STEP ATTACHMENT FOR LADDERS

This application claims benefit of provisional application No. 62/603,499, filed Jun. 1, 2017.

BACKGROUND OF THE INVENTION

This invention relates to portable steps or platforms that are adjustable, portable and mountable on a standard rung ladder. A foot pad platform is adapted to be used with generally vertically or steeply disposed ladders having side rails and a plurality of rungs.

Presently one of the major problems of being on an extension ladder or step ladder for a lengthy work session, such as painting, is the pain and discomfort one feels in the feet. That pain in the trades is called rung foot.

The reason for this pain is that the rungs or support decks designed for extension ladders and other ladders are much too small to carry the weight evenly and comfortably for a person performing work tasks for extended periods, sometimes through the day or night.

SUMMARY OF THE INVENTION

This invention assists the user with greater surface area to stand and perform work activities safely and comfortably. Some of the safety features designed into the invention include an adjustable leveling deck and swing assembly allowing the user to travel upward and downward without being inconvenienced by a stationary platform.

Also preferably included in the step device is a safe range indicator, assisting the user with a visual display as to when the device is safe to be used.

The invention provides an auxiliary foot pad platform attachable to the rungs of a conventional ladder, with the idea that the action of the ladder rung on a small area of one's feet can result in considerable discomfort during an extended work session. A platform is therefore provided, of sufficiently large surface area to permit one's feet to rest upon the flat surface, thereby affording essentially the same comfort as would be had by standing on the ground or pavement.

An added provision allows for adjustability in the angle or tilt of the foot platform to accommodate varying ladder angles. The footstep device can be attached to pairs of successive rungs along substantially the entire length of the ladder, above the bottom rung. The invention thus combines the features of adjustability and lockability with an easy to use, lightweight and portable design.

It is therefore an object of the invention to provide a ladder foot platform that incorporates a leveling mechanism for the platforms to compensate for varying ladder angles.

It is a further object of the invention to provide hooks and a support bracket which will fit ladders with rungs of various shapes and sizes and will clear rungs of the lower section of an extension ladder when used on the overlapping upper section.

Another object is to provide on the ladder a foot platform capable of articulating by left or right swinging rotation. This permits the foot platform to be out of the way of the user as the user passes by the device when traversing up or down the ladder, affording use of every rung.

A further objective is to provide an easily portable ladder platform that can be carried with just one hand. In one form the device has a weight less than 10 pounds, and more preferably less than 4.5 pounds.

A related object of the invention is to provide an improved safety foot platform of the type described wherein the platform includes means for supporting a person at a substantially level position for safety and comfort when working at any rung height on the ladder. Further, the worker can use the foot platform as a temporary scaffold, with a plank that spans two platforms in place on a ladder (or a plank that spans from one ladder to another), held safely and securely by plank retaining members keeping the plank anchored and secure while the worker stands on the plank performing work related duties.

These and other objects, advantages and features of the invention will be apparent from the following description of a preferred embodiment, considered along with the accompanying drawings.

DESCRIPTION OF THE DRAWINGS

FIGS. 7A and 7B are perspective views, each showing two of the devices of the invention secured to a ladder, with FIG. 7A showing foot platforms swung outwardly to allow a user to ascend or descend.

DESCRIPTION OF PREFERRED EMBODIMENTS

Figure 1:
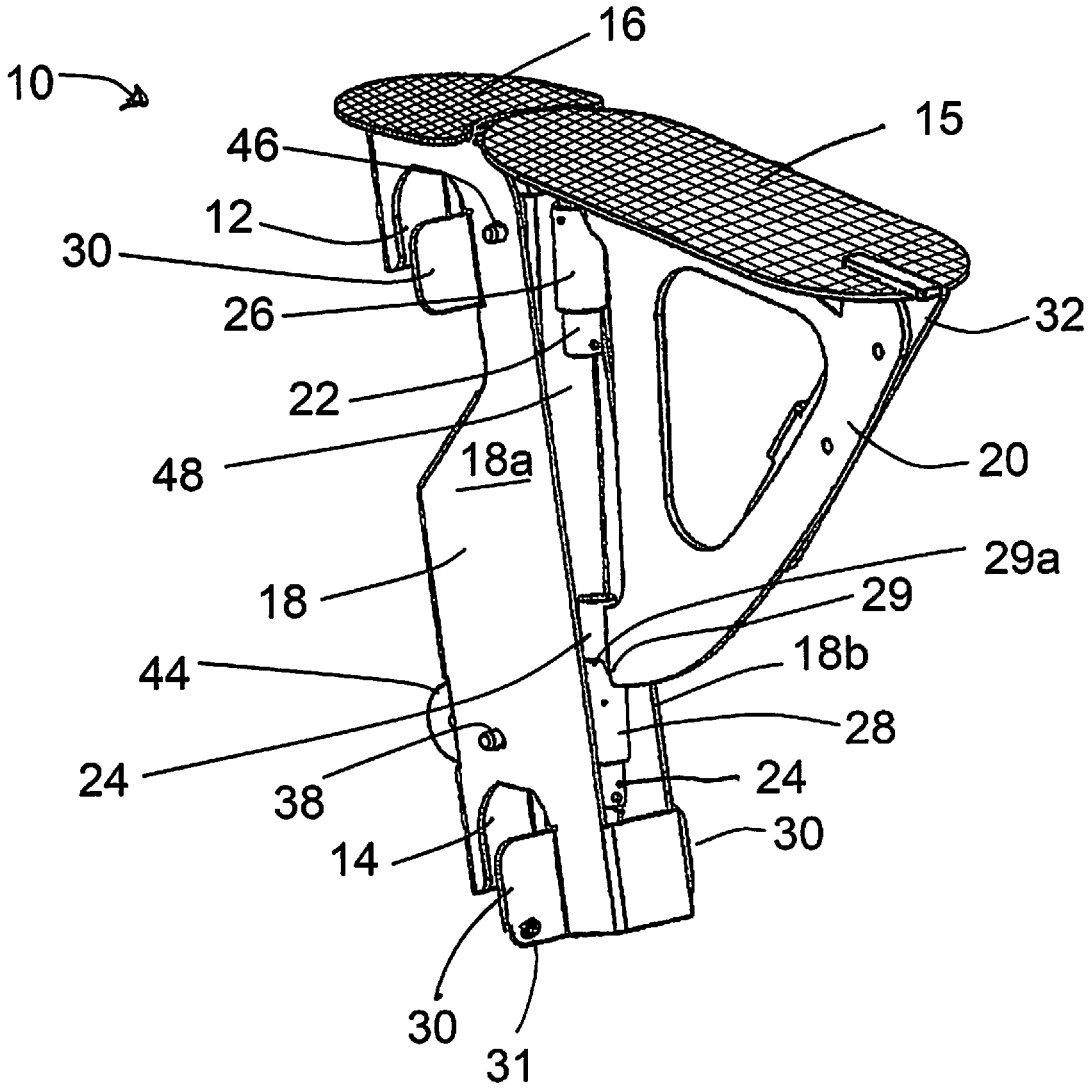
FIG. 1 is a perspective view showing the device of the invention.
Figure 2:
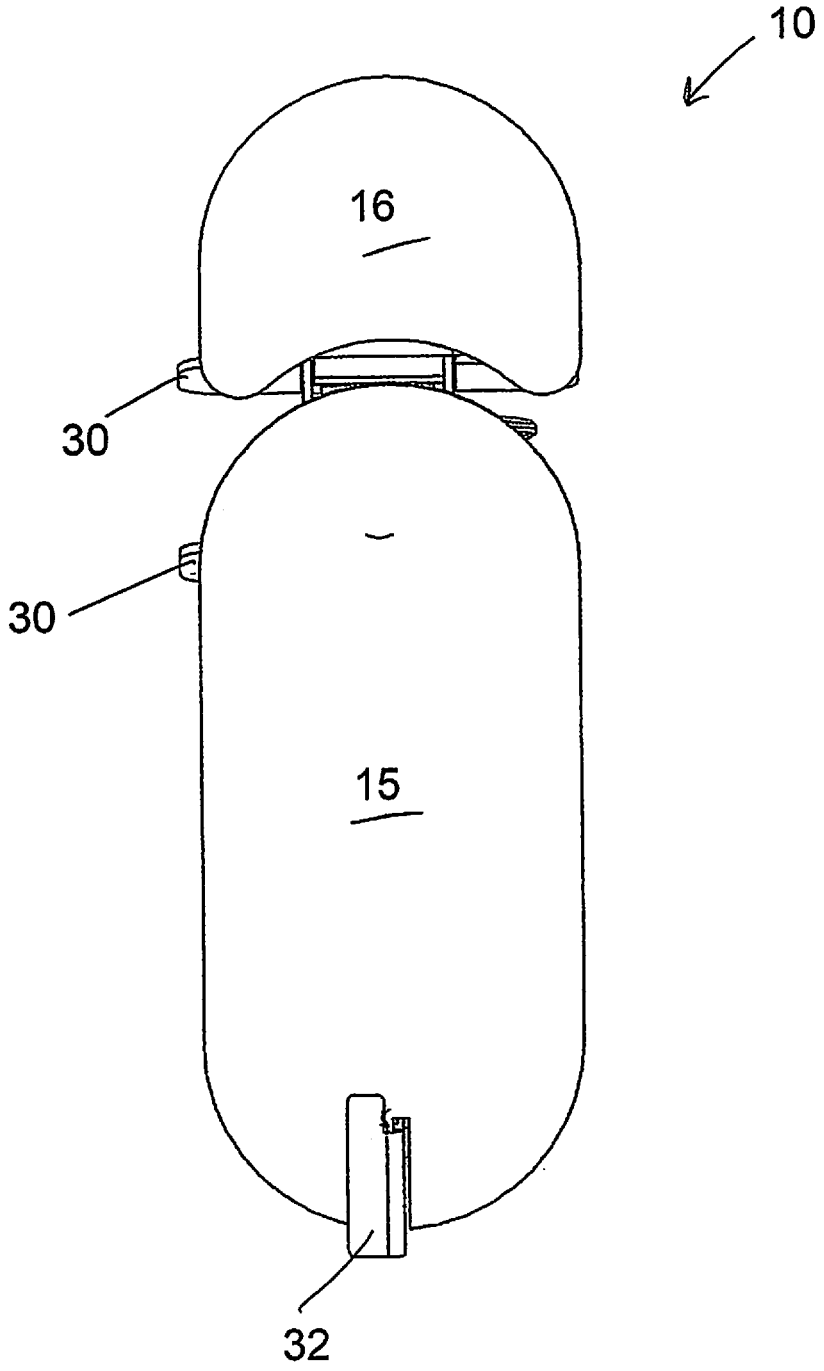
FIG. 2 is a top plan view showing the invention.
Figure 3:
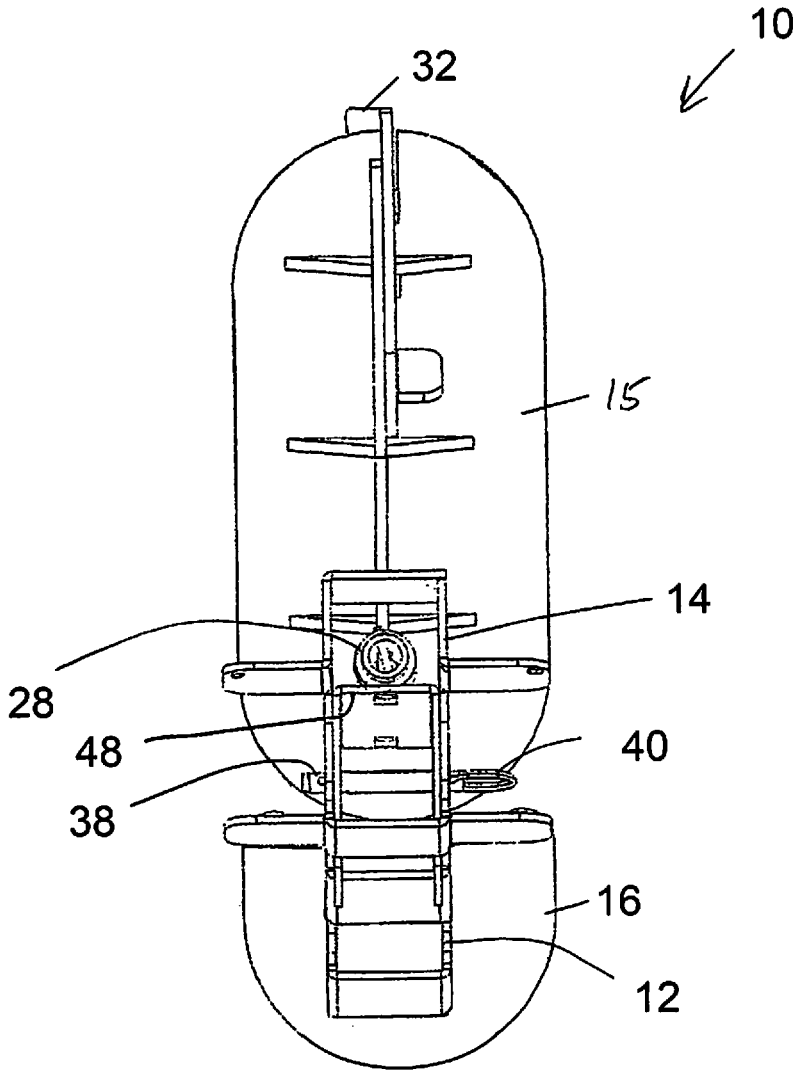
FIG. 3 is a bottom view.
Figure 4:
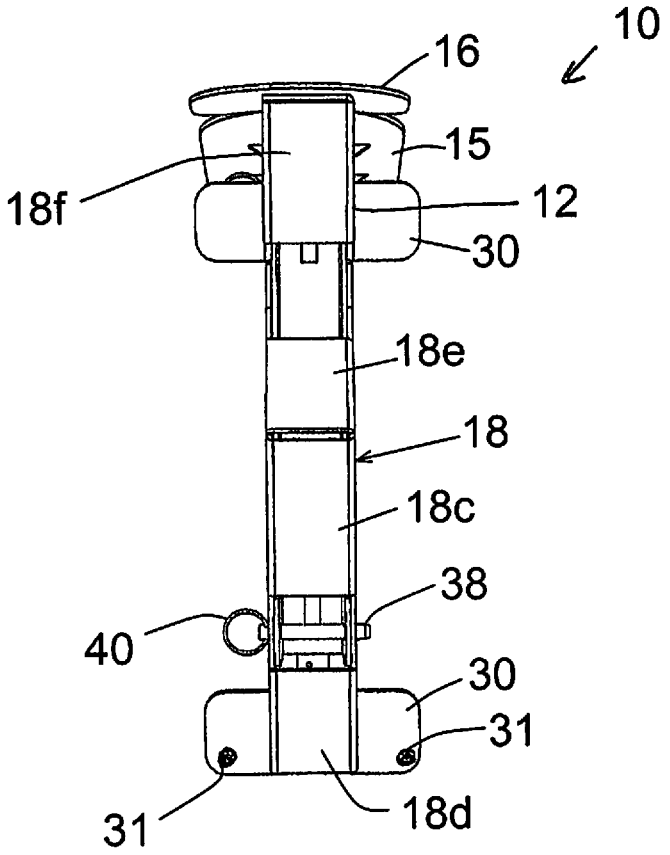
FIG. 4 is a front elevation view of the invention.

In the drawings, the ladder accessory of the invention is best understood with reference to FIG. 1, along with FIGS. 2 through 4. FIGS. 7A and 7B show the accessories in place on a ladder. The portable step platform device 10, preferably formed of metal such as steel or aluminum, includes upper and lower hooks 12 and 14 to engage over successive rungs of a ladder. These hooks are spaced apart to fit a standard ladder, normally about 12 inches from the center of one rung to the center of the next rung. The hooks are designed for essentially cylindrical rungs such as on an extension ladder or a similar rail-and-rung ladder in a single section. Some ladders vary somewhat in rung spacing, but almost all rung ladders have a rung spacing of 12 inches plus or minus ⅛ inch. The two hooks 12 and 14 have sufficient depth to accommodate a small range of variation, accommodating almost all rung type ladders.

A foot platform in a preferred embodiment is formed by a main foot platform 15 and a toe platform section 16. These can have some form of textured surface as shown in FIG. 1, for secure footing. The toe platform section is affixed to a main body portion 18 of the device, so as not to be movable in spite of any adjustments. The main foot platform 15, however, is fixed to the top of a supporting wing 20 that is pivotally connected to the main body 18. Upper and lower pivot pins 22 and 24 are shown as fixed to the support wing 20 and rotatable within cylindrical bearings or races 26 and 28. These pivot connections support the foot pad or step 15 and the wing 20 against downward movement and maintain the foot pad 15, or at least its front end, essentially aligned with the fixed front foot rest or toe section 16. Swinging movement of the wing 20 is provided for, about a generally vertical axis.

A preferred structural detail is that the two races or bearings 26 and 28, both being cylindrical tubes, are set into a rectangular slot in a structural plate 48 of the main body 18. This inset is only by a small distance, such as 1/16 inch or 3/32 inch, and can be envisioned in FIG. 1 and also FIG. 3, which shows the cylindrical tube 28 as slightly buried into the plate 48. The tube 28 is also welded or otherwise fixed in place, but the inset provides considerable vertical supporting strength.

Another preferred structural feature is effective to center the wing and step 15 when swung back from an outwardly swung position. The base end of the wing 20, at a location adjacent to the pivot pin 24, sits in a V notch 29 of the bearing tube 28, as can be seen in FIG. 1. When the wing is pivoted to either side (the device 10 can be used at either left or right on the ladder), the wing rises until it engages on a ledge 29*a* which is the top edge of the remainder of the cylinder/bearing 28. When the wing is pushed back toward center, which can be by a kick of the foot, the wing naturally finds center and the weight of the user keeps it centered.

The main body 18 preferably includes two side walls 18*a* and 18*b*, secured together by front wall sections 18*c*, 18*d*, 18*e* and 18*f* as seen in FIG. 4, as well as by the toe section 16.

It should be understood that the foot platform could be formed by the main foot support 15, extended at its front end to be cantilevered over the main body 18, eliminating the need for the separate toe section 16. Such an embodiment is not preferred because the forward toe section would swing inwardly when the larger rear section is swung outwardly, narrowing the space for a user's foot when climbing or descending. The term foot platform is intended to refer to either a two-section foot support (as illustrated) or a one-piece foot support.

The foot platform can be provided with a high-friction, non-slip surface. As an example, the metal surface could have a texture, such as ridges, waffling, knurling or roughened holes as seen in FIG. 1. Alternatively, the metal surface can be covered with rubber or other elastomeric material.

The drawings also show flanges 30 extending a short distance left and right from the main body 18. These are essentially flat, for secure and stable engagement against the rung of a ladder. A hole 31 (about 3/8 or 7/16 inch) can be included near the outer edge of each of the left and right flange, to receive a carabiner or other hook, for hanging a brush or other tools or supplies from the device. This can also be for using a carabiner (or a line with one at each end) to hang the step device from the worker's belt, belt ring or tool belt as the worker ascends or descends the ladder with hands free to grasp rungs.

Figure 5:
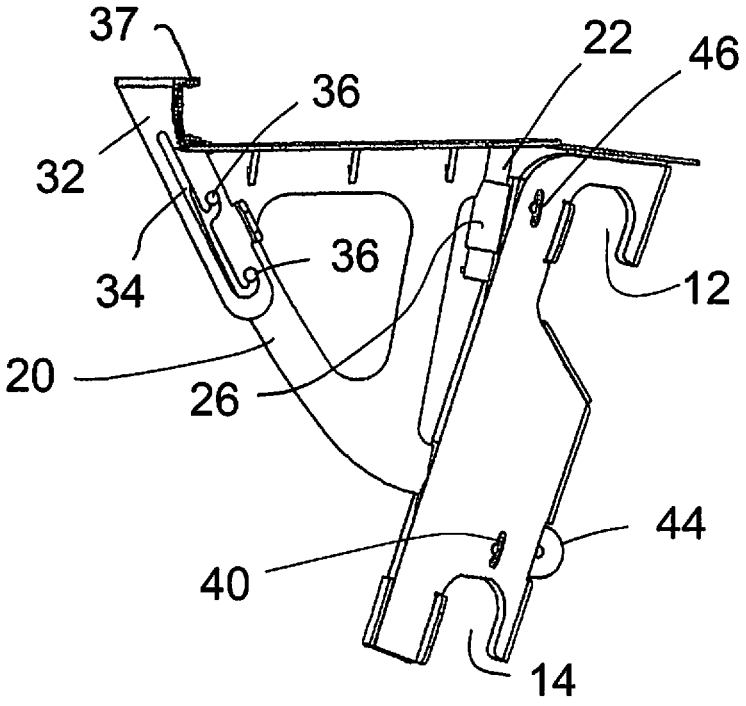
FIG. 5 is a right side view of the device, with a plank retainer deployed.

Further, the temporary step device preferably includes a deployable plank retainer 32, shown in stowed position in FIG. 1 but in deployed position in FIG. 5. As shown in these drawings, the plank retainer can be slidable up and down via an elongated slot 34 that rides on a pair of pins 36, the slot having hooked side tracks as shown to hold the retainer in the raised, deployed position. A forwardly projecting flange 37 holds a plank from lifting. The plank retainer could take other forms, such as a flip-up abutment or even a fixed upward lip at the back of the foot platform, to be behind a user's heel, although this would be less effective than what is shown.

Figure 6:
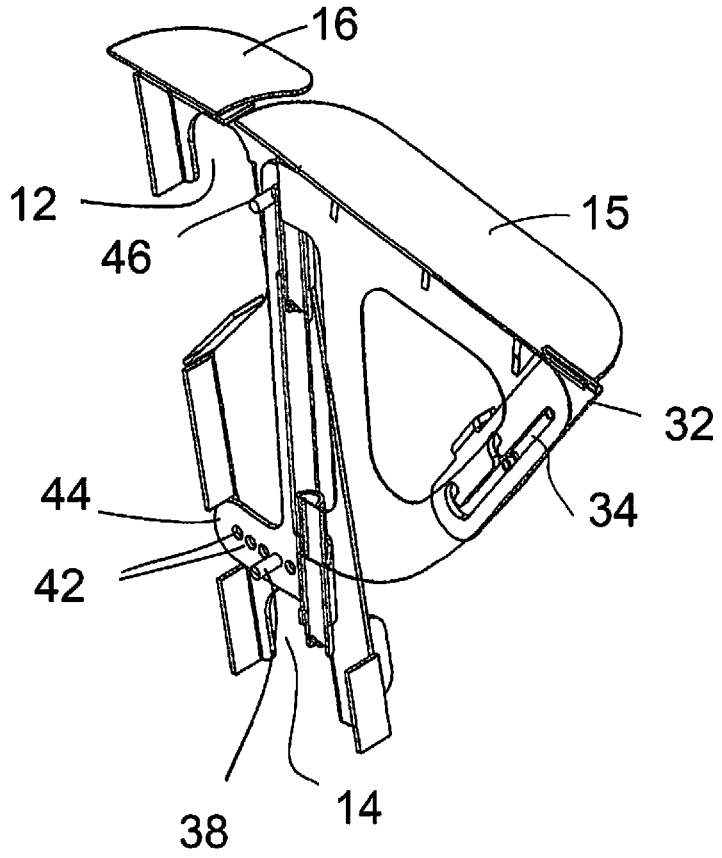
FIG. 6 is another perspective view showing the device with a side plate removed, to illustrate an adjustment feature for accommodating different ladder angles to hold the foot platform generally horizontal.

An important feature of the invention is adjustability of the tilt angle of the foot platform relative to the main body 18 of the device. In the embodiment depicted it is the main platform 15 that is adjustable. This is to accommodate differing ladder inclinations, to enable the foot platform to be essentially leveled. FIG. 6 reveals the mechanism for this adjustment, a slidable pin 38 (or bolt or rod) with a handle 40 (FIG. 5) at one end, essentially a grip ring. This pin resides in a hole through the main body 18, e.g. aligned holes of the left and right side walls 18*a* and 18*b* of the main body 18, in the embodiment shown. The pin can be pulled out and re-inserted through any one of a series of positioning holes 42 in a forward extension piece 44 connected to the adjustable wing member 20. The adjustable wing member is secured to the main body 18 by a pivot pin 46 near the top end, about which the wing is swung upwardly or downwardly, as well as by the angle adjustment pin 38. (the pin 46 can be removable, as is the pin 40, for an embodiment wherein the wing 20 with platform 15 can be removed and attached onto a different body (not shown) for securing to a step ladder).

Note that in a unitary foot platform embodiment the angle adjustment will function as described above except that the front end of the platform will not be attached directly to the top of the main body 18 and will vary in distance from the main body as tilt adjustments are made.

In this preferred embodiment the wing member 20 is actually connected indirectly to the main body 18. The pivot pin 46 and the positioning pin 38 in this form of the device engage with a generally vertical bar or plate structural member 48, from which the forward extension adjustment piece 44 extends. This indirect connection accommodates the left/right swing movement capability of the wing member 20 as discussed above. Thus, the cylindrical races or journals 24 and 26 are fixed to the generally vertical plate or bar 48 (as discussed above), and the wing member 20 can be swiveled relative to that bar. In this way, the illustrated preferred embodiment allows for motion of the wing member 20 (and the foot platform 15) about two axes: a horizontal axis at the tilt adjustment pin 46, and a generally vertical axis defined by the pivot pins 22 and 24 for swinging the wing member 20/platform 15 left or right.

FIGS. 7A and 7B show the portable foot platform device in use on a ladder. Two of the devices are shown extending between and secured on a pair of ladder rungs 50 and 52. Only a portion of the ladder 54 is shown. In FIG. 7A the portable foot platform devices are shown with the main foot platform sections 15 swung left and right to accommodate the user's ascent or descent of the ladder. In FIG. 7B the two devices are shown with the main foot platform sections centered and perpendicular to the ladder rails 56 and in position for use.

Figure 8:
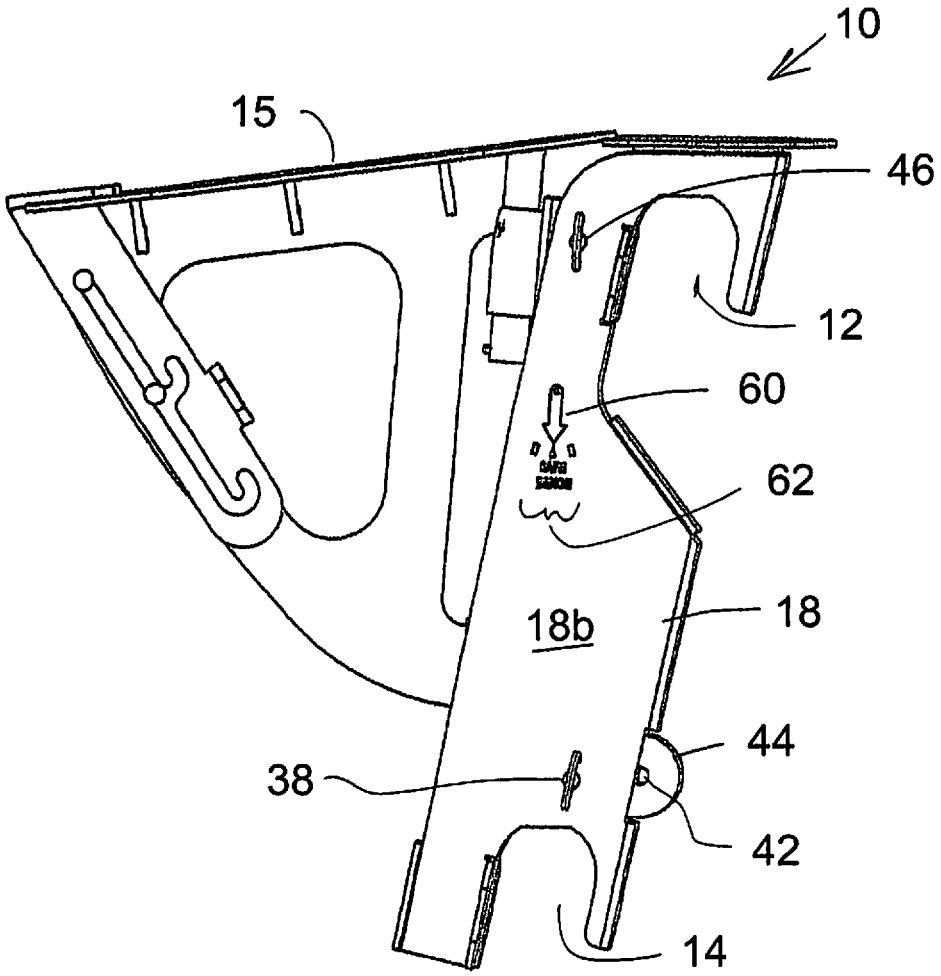
FIG. 8 is a side view of the device illustrating a safe range indicator for the angle of the foot platform, as related to the angle of inclination of the ladder.

In FIG. 8 the ladder step accessory 10 is shown in a side elevation view, from the right side, and illustrating a "safe range" indicator 60. The indicator is a pointing arrow that hangs by gravity to point vertically downwardly, thus pointing toward a range of marks 62. The position of the pointing arrow changes as the ladder angle is changed, and the indicia 62 show a safe range, the preferred safe range being about 70° to 75°. Thus, even though a series of positioning holes 42 are included in the extending flange 44 from the wing, to be engaged by the pin 38, these holes may provide a wider range of tilt adjustment than what is considered the preferred "safe range".

Figure 9:
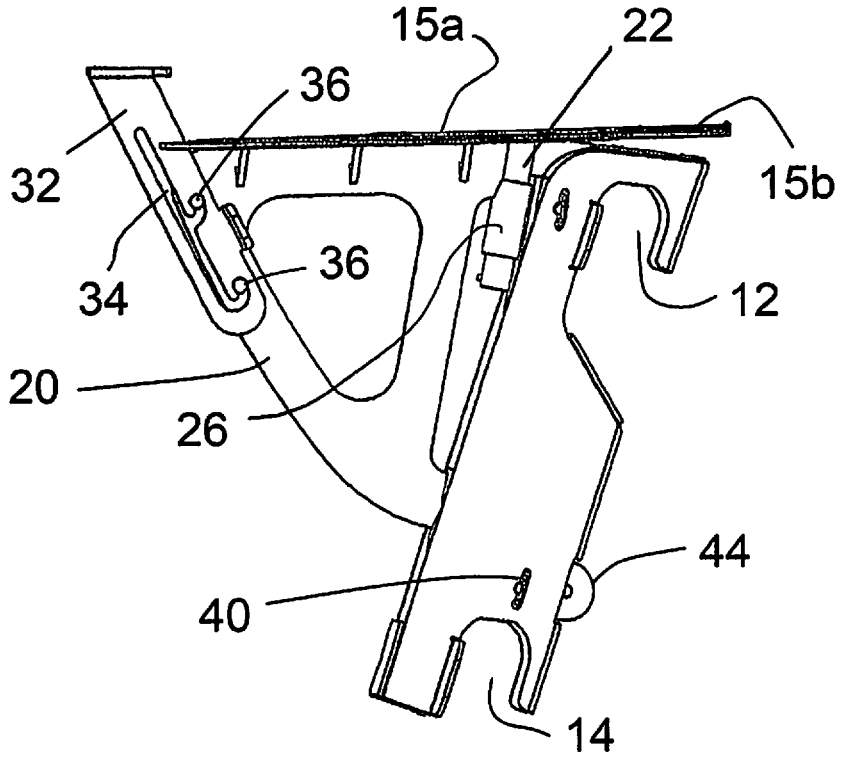
FIG. 9 is a side view similar to FIG. 5, but showing a variation with a unitary foot platform.

FIG. 9 shows a variation of the invention discussed above, wherein the foot platform is a unitary piece 15*a*. As noted above, this embodiment is not favored because the forward, toe end 15*b* will swing inwardly when the wing 20 is swung outwardly, requiring a compromise in the length of the platform forward of the pivot 22.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

We claim:

1. A footstep device for attachment to a ladder with rungs, comprising:

a main body having upper and lower ends, with an upper rung hook near the upper end and a lower rung hook near the lower end, a wing member connected to a back side of the main body, with a height less than that of the main body, the wing member supporting a foot platform at a top end of the wing member, and the wing member being connected to the main body at a horizontal pivot near the upper end of the main body, such that an angular tilt orientation of a plane of the foot platform relative to the main body can be adjusted to accommodate a ladder's angle of inclination when the footstep is attached to the ladder, and with tilt locking means for holding a selected angular inclination of the foot platform, and the wing member being connected to the main body via a generally vertical bar or plate which is connected to the main body at said horizontal pivot axis, and the generally vertical bar or plate having at a bottom end an adjustment extension protruding toward the front of the main body, the adjustment extension having a series of spaced positioning holes to be aligned with a horizontal hole in the main body to define a desired angular orientation of the plane of the foot platform relative to the main body, and including a pin or rod adapted to be inserted through the main body and a selected one of said positioning holes serving as said tilt locking means, and wherein the wing member is attached to the generally vertical bar in a swiveling pivot connection on a swivel axis generally parallel to the bar, thereby allowing the foot platform to be swung laterally outwardly when the device is engaged on the ladder, so as not to obstruct a user's ascent or descent of the ladder, past the footstep device.

2. A footstep device as in claim 1, wherein the swiveling pivot connection comprises a pair of aligned and spaced apart pins on the wing member, each positioned in a cylindrical bearing member on the generally vertical bar.

* * * * *